United States Patent [19]

Westberg

[11] Patent Number: 4,776,473

[45] Date of Patent: Oct. 11, 1988

[54] CRANE HOUSE

[75] Inventor: Bengt Westberg, Domsjö , Sweden

[73] Assignee: AB Hagglund & Soner, Ornskoldsvik, Sweden

[21] Appl. No.: 70,048

[22] Filed: Jul. 6, 1987

[30] Foreign Application Priority Data

Jul. 9, 1986 [SE] Sweden ..... 8603066-5

[51] Int. Cl.[4] ..... B66C 23/26

[52] U.S. Cl. ..... 212/175; 212/190; 212/271

[58] Field of Search ..... 212/160, 165, 175, 182, 212/190, 223, 232, 255, 271

[56] References Cited

U.S. PATENT DOCUMENTS

| | | | |
|---|---|---|---|
| 2,572,029 | 10/1951 | Huston | 212/165 |
| 4,053,061 | 10/1977 | Lester | 212/165 |
| 4,166,517 | 9/1979 | Henderson | 114/362 |

FOREIGN PATENT DOCUMENTS

| | | | |
|---|---|---|---|
| 906908 | 2/1982 | U.S.S.R. | 212/165 |
| 1167144 | 7/1985 | U.S.S.R. | 212/165 |

*Primary Examiner*—Joseph F. Peters, Jr.
*Assistant Examiner*—Stephen P. Avila
*Attorney, Agent, or Firm*—Cushman, Darby & Cushman

[57] ABSTRACT

A crane house includes an operator cabin mounted on the house, and an opening permitting access to the crane house from without for the purpose of minimizing the openings in a crane house of this kind, which is achieved by closing the access opening to the crane house with a hinged cover carrying the operator cabin, a door opening provided in the cabin for a door lying within the area of the crane house define by the cover and co-acting with an opening provided in the cover for permitting entry to the cabin from within the crane house.

11 Claims, 3 Drawing Sheets

CRANE HOUSE

The present invention relates to a crane house which includes an operator's cabin mounted thereon, and an opening which affords entry to the crane house from without. The invention can be applied to particular advantage with load-handling cranes of the kind normally found on seagoing vessels and in marine docks, and with which the crane house is supported on a foundation structure.

It is a requirement of such cranes that the crane operator has access to the operator cabin, which is located at some considerable height above the bottom of the foundation structure, without needing to climb slippery stairways, ladders or the like. For this reason the crane house and foundation structure are constructed so that the operator is able to climb within the confines of the foundation and crane house, so as to be able to enter the cabin safely through an opening in the crane house, without being subjected to the effect of external environments. The crane house usually incorporates an opening through which access can be had to the crane machinery from without, this opening being large enough to permit crane machine components to be replaced or exchanged.

The object of the invention is to provide improvements in such crane houses.

This object is achieved in accordance with the invention in that the access opening permitting entry to the crane house is closed by a hinged cover which carries the operator cabin thereon, and in that a door opening incorporated in the cabin for accommodating a door lies within the area of the crane house defined by the cover, said door opening co-acting with an opening arranged in the cover, to provide entrance to the cabin from within the crane house. This lends to two important advantages over known technique, firstly fewer openings need to be incorporated in the crane house and secondly the cover and the operator cabin can be mounted in the form of a unit, independently of the mounting of the remaining structural components of the crane.

Figure 1:
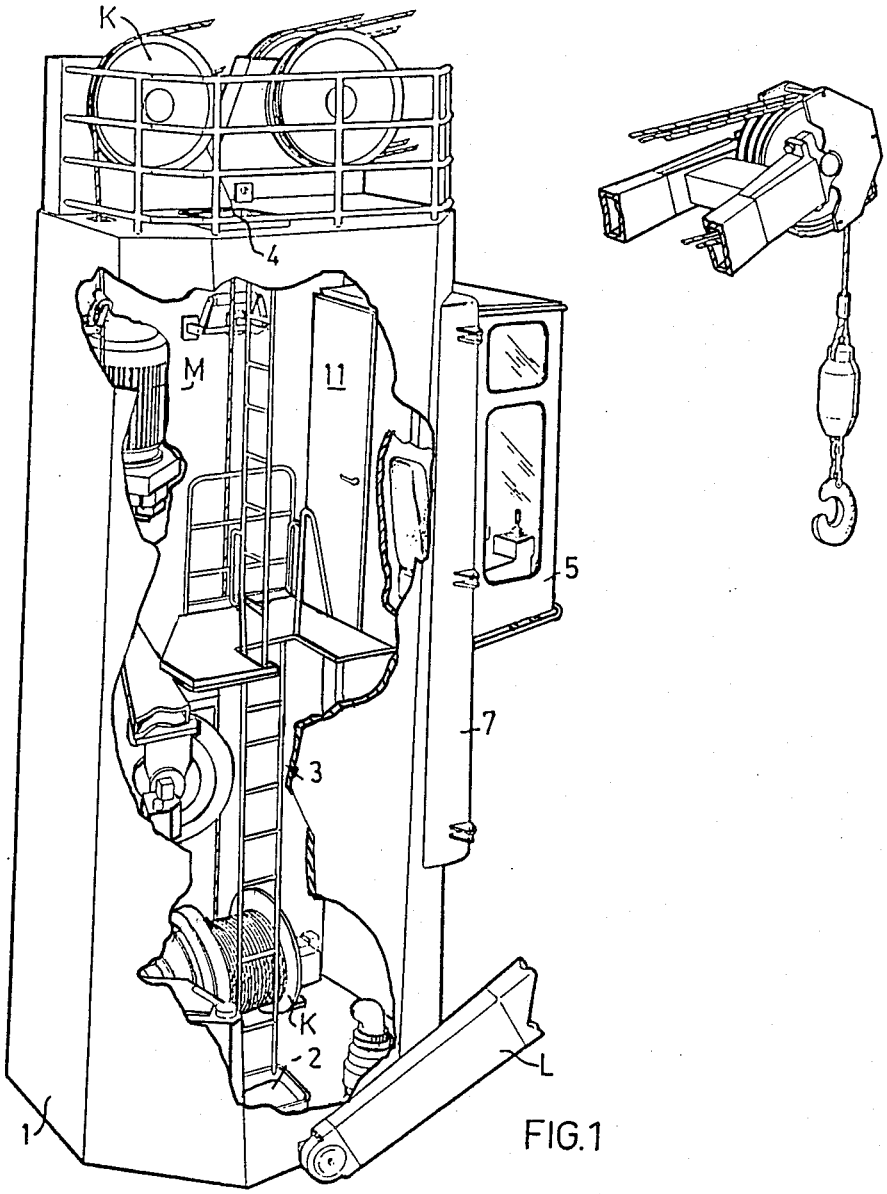
Figure 2:
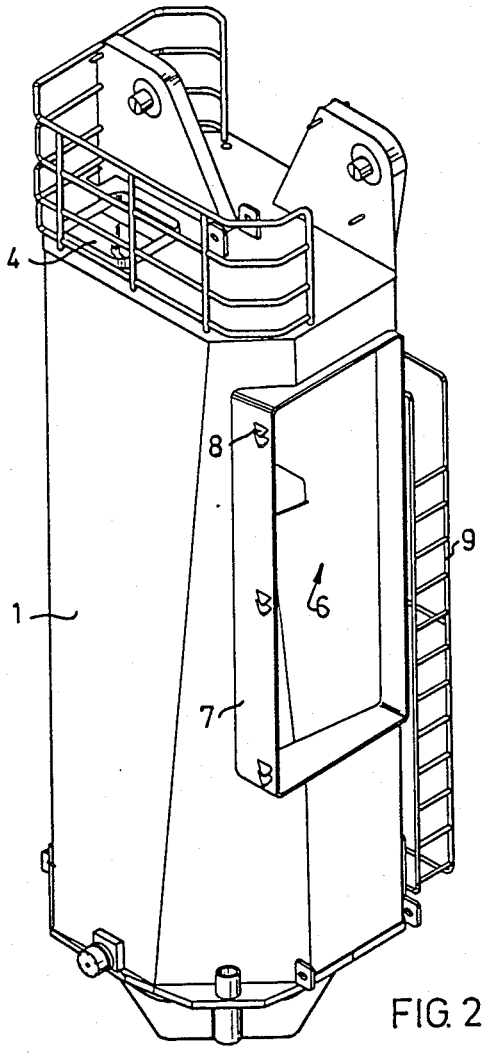
Figure 3:
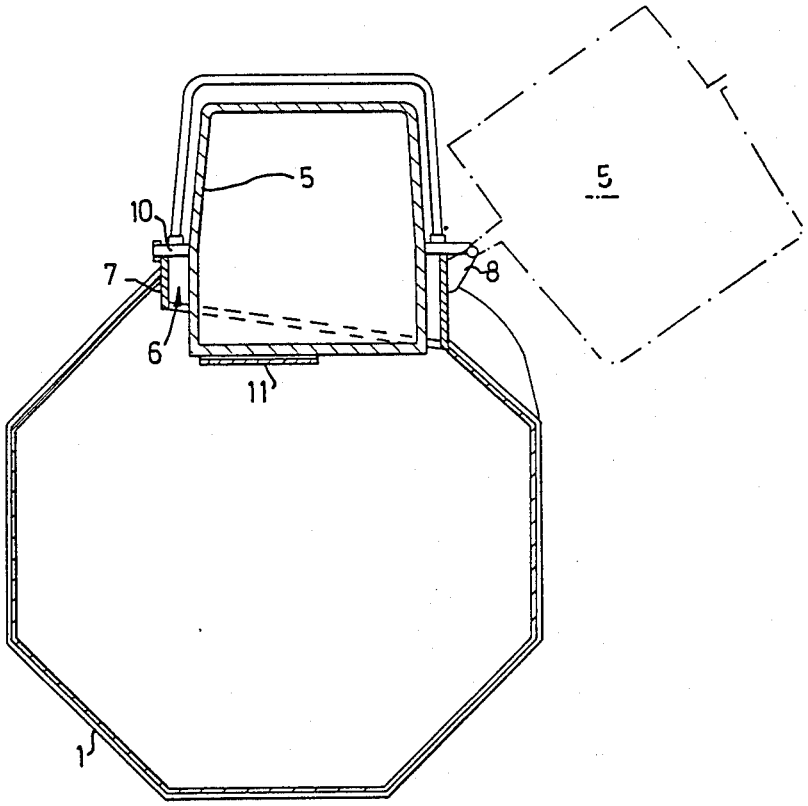

These and other advantages will be apparent from the following detailed description of a preferred embodiment of a crane house constructed in accordance with the invention and illustrated in the accompanying drawings, in which FIG. 1 is a perspective view of a crane house according to the invention, taken obliquely from the rear and with parts of the house partially cut away;

FIG. 2 is a perspective view of the crane house illustrated in FIG. 1, seen obliquely from the front of the crane house without the cover member and crane machinery; and FIG. 3 is a schematic, horizontal cross-sectional view of a crane house according to the invention having an operator cabin mounted thereon.

In addition to the crane house and the operator cabin mounted thereon, FIG. 1 also illustrates some of the devices and components incorporated in such cranes, for instance, the lifting jib L, cable-drum motor K and drive motors M. The crane operating devices and crane operating mechanisms are of a known kind and will therefore not be described here. In order to understand the invention it is sufficient to know that operating devices arranged in the operator cabin are connected to the operating mechanism.

The crane house 1 illustrated in the Figures is connected at the bottom thereof to a foundation structure (not shown). An opening 2 leads from the foundation structure into the interior of the crane house. A ladder system 3 extends from this opening to an opening 4 closed by a lid in the upper part of the crane house. In addition to permitting access to an operator cabin 5 from within the crane house, this ladder system also permits maintenance and supervision of components of the crane operating mechanism located within the crane house.

FIG. 2 is an illustration of the crane house in the absence of associated components. As will be seen from this figure, the crane house has arranged therein a large opening 6, which enables large components to be readily moved into the crane house. Since this opening lies at a relatively long distance from the bottom of the crane house, a favourable location is obtained from the aspect of mechanical strength.

Arranged within this opening is a frame structure 7 of which one long side is broader than the other long side and which carries pairs of hinge flanges 8 on the broader long side. The breadth of this long side is adapted so as to permit the outwardly directed opening plane of the frame structure to be adjusted so that it lies substantially in the same plane as that side of the crane house on which the greater part of the opening 6 is situated. Since the frame, in its entirety, is relatively broad, it can also be adjusted vertically in the opening 6. This enables the opening plane of the frame 7 to be oriented, to some extent, independently of the contour of the opening 6. The frame 7 is fastened to the defining edges of the crane-house opening 6 in some suitable manner, preferably by welding. As will also be seen from FIG. 2, a ladder 9 is mounted on the crane house 1 adjacent the opening 6, on the opposite side of the hinge flanges 8, so as to permit access to the opening 6 from without.

As illustrated in FIGS. 1 and 3, the opening 6 is closed by means of a cover 10, which rests against the peripheral edges of the frame and which is pivotally connected to the frame on the pairs of hinge flanges 8. An operator cabin 5 is mounted in the upper part of the cover and carried thereby. The rearwardly located part of the operator cabin projects inwardly beyond said cover through an opening therein, and the inwardly located rear wall of the cabin has arranged therein a door 11 for access to said cabin. The side of the hinged cover opposite to that on which the hinges are mounted suitably has provided thereon fastener means for securing the cover in its closed position. The hinged cover is also provided with suitable seals around the peripheral edges thereof, so as to fit sealingly against the frame 7, and a pivot mechanism is provided for pivoting the cover, this mechanism being of any suitable kind. The supply lines leading to the operating devices in the operator cabin are connected to lines arranged in the crane house with the aid of sliding contacts of some suitable kind capable of accompanying the swinging movement of the cabin.

Thus, there is obtained in accordance with the invention a crane house of the aforedescribed kind which has solely one opening in its side walls, which constitutes an improvement in relation to prior known crane housings from the aspect of manufacture and mechanical strength. Furthermore, the operator cabin is carried on a hinged cover which is fitted onto the crane house subsequent to its construction and subsequent to installing the crane components therein. Thus, the operator cabin can be mounted on the cover irrespective of the assembly stage of the crane house in general and without influencing this assembly or construction in any way, which is a further advantage in relation to the known technique. It will be understood that the described embodiment of the invention can be modified in several ways within the scope of the invention, and that the scope of the invention is therefore solely limited by the content of the following claims.

I claim:

1. A crane house having an opening which permits access to the crane house from outside the crane house, said access opening being large enough to permit passage therethrough of large machine components, a frame structure attached to the edges of said access opening and surrounding said access opening, a cover hingedly connected to one side of said frame structure for swinging movement between a first position in which said cover closes said access opening and a second position in which said cover has been swung away from said access opening, an operator cabin carried by said cover and a door opening provided in the operator cabin for a door, said door opening lying within the area of the crane house defined by the hinged cover, said door opening co-acting with an opening provided in the hinged cover for permitting entry to the operator cabin from within the crane house, said frame structure being relatively broad such as to permit the outwardly directed opening plane of the frame structure to slope in relation to the plane of said access opening.

2. A crane house according to claim 1, characterized in that the side of the frame on which the door is hinged is broader than the opposite side of the frame.

3. A crane house according to claim 2, characterized in that the rearward part of the operator cabin projects inwardly beyond the frame opening and incorporates a door in said door opening for access to the operator cabin from within the crane house.

4. A crane house according to claim 1, characterized in that operating means in the operator cabin are connected to crane-machinery drive-components arranged within the crane house by means of sliding contacts which permit the hinged cover to be swung without breaking the connection between the aforsaid operating means and the crane machinery.

5. A crane house according to claim 1 and including a crane foundation structure, characterized in that the part of the crane house located nearest the crane foundation structure is imperforate, i.e. presents no through-passing openings.

6. A crane house comprising a side wall having an opening through which access can be had from the outside of the crane house to crane machinery contained in the crane house, said access opening being large enough to permit crane machine components to be replaced or exchanged, a cover hinged to said crane house for opening and closing said access opening, and an operator cabin which is carried by said hinged cover, said operator cabin having a door opening for a back door, said door opening cooperating with an opening in said cover in order to permit entry to said operator cabin from the inside of the crane house when said cover is in its closed position.

7. A crane house as in claim 6 wherein said cover is hinged to one side of a frame structure which is fixed to said crane house, said frame structure surrounding said access opening and having an opening therein which cooperates with said access opening, said frame structure being relatively broad such as to permit the outwardly directed opening plane of the frame structure to slope in relation to the plane of said access opening.

8. A crane house as in claim 7 wherein the side of the frame structure on which said door is hinged is broader than the opposite side of the frame.

9. A crane house as in claim 8 wherein said operator cabin has a rearward part extending inwardly into the crane house beyond said frame opening, said door opening being in said rearward part, and a door in said door opening for access to said operator cabin from within the crane house.

10. A crane house as in claim 6 including operating means in said operator cabin connected to crane machinery drive components arranged within said crane house by means of sliding contacts which permit said cover to be swung without breaking the connection between said operating means and the drive components.

11. A crane house as in claim 6 including a crane foundation structure, and wherein the part of the crane house located nearest said foundation structure is free of pass-through openings.

* * * * *